United States Patent [19]

Grashow

[11] 4,184,162

[45] Jan. 15, 1980

[54] AERIAL MOUNTING WITH RIGHT ANGLE CONNECTION

[76] Inventor: Joseph Grashow, 4190 Bedford Ave., Brooklyn, N.Y. 11229

[21] Appl. No.: 937,475

[22] Filed: Aug. 28, 1978

[51] Int. Cl.[2] ..... H01B 17/26; H01Q 1/50; H01Q 1/32

[52] U.S. Cl. ..... 343/715; 343/906; 174/153 A

[58] Field of Search ..... 343/715, 906; 174/86, 174/138 A, 139, 153 A; 343/713, 749

[56] References Cited

U.S. PATENT DOCUMENTS

| | | | |
|---|---|---|---|
| 2,252,671 | 8/1941 | Ludwig | 343/715 |
| 2,495,517 | 1/1950 | Friedberg | 343/906 |
| 2,880,265 | 3/1959 | Race | 343/713 |
| 3,145,384 | 8/1964 | Nuttle | 343/749 |
| 3,355,703 | 11/1967 | Alibert | 339/177 R |
| 3,492,769 | 2/1970 | Olson | 343/713 |
| 3,685,006 | 8/1972 | Jerrold-Jones | 174/75 C |
| 3,728,666 | 4/1973 | Shirey | 174/75 C |
| 4,058,811 | 11/1977 | Gauss et al., | 343/715 |

FOREIGN PATENT DOCUMENTS

| | | | |
|---|---|---|---|
| 1225820 | 2/1959 | France | 343/715 |

*Primary Examiner*—Alfred E. Smith
*Assistant Examiner*—Harry E. Barlow
*Attorney, Agent, or Firm*—Brumbaugh, Graves, Donohue & Raymond

[57] ABSTRACT

An antenna mounting structure, for mounting an antenna on a mounting surface with a limited amount of under space, has a coaxial cable attached substantially at a right angle to the axial direction of the mounting structure. The mounting structure includes an antenna base assembly having a lower portion disposed beneath the mounting surface. An antenna disposed in the base also projects below the mounting surface into a cavity in the base, and an aperture is provided in the side of the lower portion of the base. The mounting structure also includes a cable mounting assembly having a cable adapter in the form of a plate with an aperture, on which plate the outer lead of the coaxial cable is fixed so that the cable is substantially parallel to the plate at the connection, the inner lead of the cable extending into the aperture. The cable and adapter are dimensioned such that, when assembled with the base, the inner lead projects into the antenna base cavity and can make contact with the antenna.

7 Claims, 11 Drawing Figures

FIG. 1
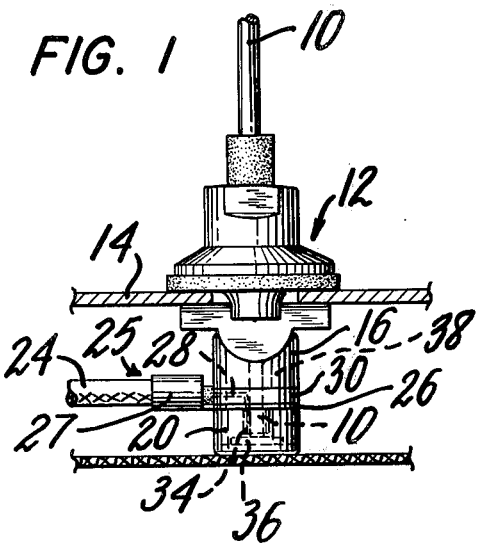
FIG. 3
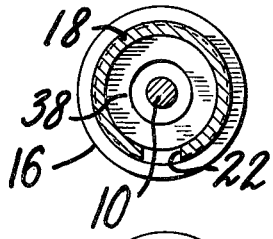
FIG. 4
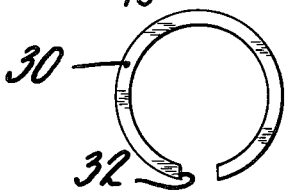
FIG. 5
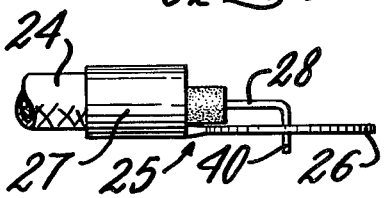
FIG. 2
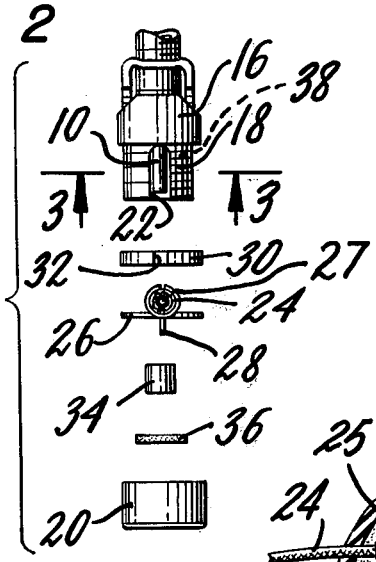
FIG. 6
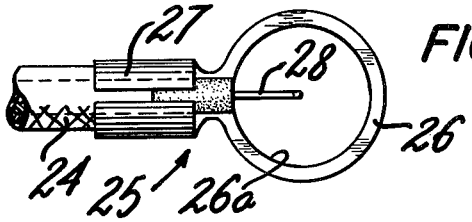
FIG. 7
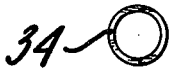
FIG. 8
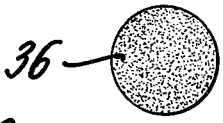
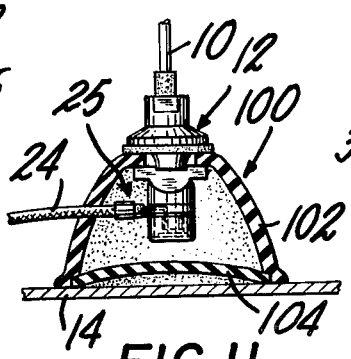
FIG. 11
FIG. 9
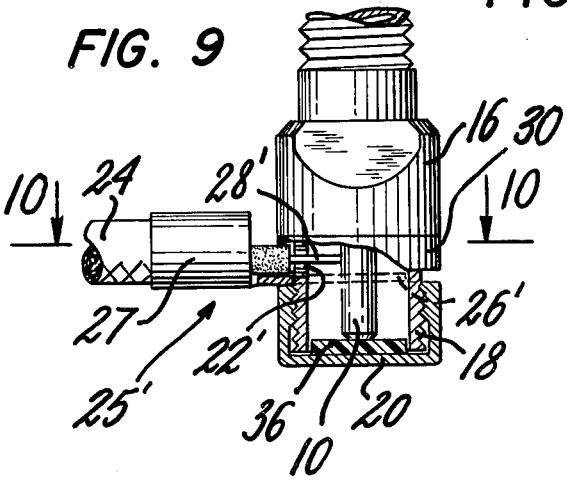
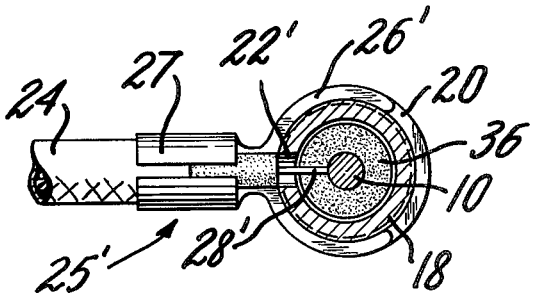
FIG. 10

AERIAL MOUNTING WITH RIGHT ANGLE CONNECTION

BACKGROUND OF THE INVENTION

The present invention relates to antenna mountings and, more particularly, to vehicle antenna mounting structures for mounting antennas on sheet metal mounting surfaces of the vehicle lacking in a great deal of under space between the sheet metal and the interior padding of the vehicle.

There are presently known a number of antenna mounting structures having generally tubular base portions of conducting material. With structure of this type, the antenna is secured within the base and is electrically insulated therefrom. The antenna is connected to the automobile radio by way of a coaxial cable, the inner lead of which is connected to the antenna and the outer lead of which is connected to the base.

A common cable attachment for a tubular-type base antenna is shown in U.S. Pat. No. 2,509,563 to Grashow. In this patent an antenna mounting structure is illustrated which is particularly advantageous in that it may be installed completely from the outside of the mounting surface through a relatively small mounting aperture. When mounted, a portion of the base is disposed beneath the mounting surface and the lower end of the antenna is also beneath the mounting surface, it being disposed within the tubular cavity of the base. A convenient cable attachment is provided in the form of a threaded cap which engages a cooperating threaded portion of the base and also provides electrical contact between the outer lead and the base. The inner lead projects upwardly into the base cavity and is held in contact with the antenna by means of a cooperating pin and plug. Another convenient antenna attachment is shown in U.S. Pat. No. 2,536,053 to Grashow, in which one end of the coaxial cable is provided with a plug adapted to be inserted into the base cavity from below. The inner lead of the cable contacts the antenna by means of a connecting pin projecting from the plug.

Each of the aforementioned cable adaptors provides a simple and expedient means for attaching the cable to the antenna base. This allows the cable and antenna to be sold disassembled and to be attached together just prior to installing the antenna, or to be detached easily, for example, when replacing the antenna.

Connectors of this type, however, are not particularly well suited for installations where the antenna is to be mounted to a mounting surface lacking in a great deal of under space, that is, space between the sheet metal mounting surface and roof padding, since the cable at the connection projects downwardly in the axial direction of the base. In addition, in externally-mountable antennas such as Grashow Pat. No. 2,536,053, the antenna is mounted with the cable already attached and, during one phase of the mounting operation, the antenna base must be lowered through the mounting aperture to a point below where it will be finally secured to the mounting surface (in order to rotate the lower support arms).

Several arrangements are known in the prior art in which an antenna base mounting structure is provided with a cable connection in which the coaxial cable is mounted such that it extends from the mounting structure at a right angle to the axial direction of the base. One such arrangement is shown in U.S. Pat. No. 2,252,671 to Ludwig. In that patent the outer lead of the cable is connected to a ground sleeve by means of a spur, and the inner lead is in electrical contact with the antenna by means of a stud inserted through an aperture in the ground sleeve and insulating sleeve. The use of the ground sleeve and stud increases the time and expense of manufacturing this antenna. Also, the Ludwig antenna is concealed in a sleeve that extends far below the mounting surface, thus making it inappropriate for use where there is limited under space. In fact the right angle connection of Ludwig simply makes it possible to connect a cable to an antenna that is to be stored below a mounting surface and is unrelated to the saving of space.

A more simple arrangement for mounting a cable at a right angle is shown in U.S. Pat. No. 3,145,384 to Nuttle which described an antenna mounting structure that does not extend substantially below the mounting surface. In Nuttle, the coaxial cable is attached to a backing subassembly including a plate having a circular aperture over which a threaded connector jack nipple is welded. The outer lead is connected to this plate and the inner lead extends into the aperture and contacts an inner conductor of the jack. The plate attaches to the bottom of the mounting surface so that the jack extends through a hole in that surface. The antenna screws onto the threads of the jack projecting beyond the mounting surface. The backing subassembly, however, is costly to manufacture and difficult to assemble.

SUMMARY OF THE INVENTION

The present invention is directed to an antenna mounting structure having a coaxial cable mounting assembly which provides the advantages of being simple in structure and at the same time being adapted for quick and easily assembly and disassembly, while obviating the disadvantages of the prior known structures when attached to a mounting surface having limited under space.

These and other advantages are accomplished by providing an antenna mounting structure having a simple and easy to attach cable mounting assembly for attaching the coaxial cable at substantially a right angle to the axial direction of the mounting structure. The mounting structure has a base attached to a mounting surface in such a way that its lower portion is disposed beneath the mounting surface. The antenna is supported within the base and extends into a cavity in the lower portion of the base. An aperture is formed in the side of the base lower portion, which aperture extends to the cavity. The aperture is large enough for the inner lead of the coaxial cable to pass through the aperture into the cavity at substantially a right angle to the axial direction of the base. Preferably this aperture is a channel formed in the base lower portion and extending in an axial direction from the lower end.

The cable mounting assembly comprises a cable adapter in the form of a plate with an aperture, the outer lead of the coaxial cable being fixed to the plate so that the cable is parallel to the plate at the connection. The inner lead extends into the aperture and is preferably bent at its end perpendicular to the plane of the plate. The cable and adapter are dimensioned such that, when assembled with the base, the inner lead projects through the base aperture into the cavity and the bent portion makes contact with the antenna. The mounting assembly also includes means for securing the inner lead to the antenna, which may comprise a clamping sleeve which snugly fits over the bent portion of the inner lead and antenna, and means for securing the adapter plate to the base at a right angle, such as a threaded cap which may be screwed over the plate onto cooperating threads on the base. In one form of the invention, the cable adapter is a flat ring with a cable attaching portion extending from the ring. The corresponding aperture in the base lower portion is a channel formed lengthwise in the axial direction of the base. In this arrangement, the adapter ring is inserted over the base lower portion, with the inner lead extending through the base aperture as the cable mounting assembly is attached to the base. In an alternative embodiment, the cable adapter aperture is open at one end, such that it may be inserted on the base from the side. In this form of the invention, the aperture need only be a hole through which the inner wire is fed as the adapter is inserted onto the base.

BRIEF DESCRIPTION OF THE DRAWINGS

For a further understanding of the present invention, reference may be had to the following detailed description and the accompanying drawings in which:

FIG. 1 is a side view of an antenna mounting structure according to the present invention;

FIG. 2 is an exploded front view illustrating the parts constituting the lower portion of the antenna mounting structure of FIG. 1;

FIG. 3 is an enlarged sectional view taken along line 3—3 of FIG. 2;

FIG. 4 is an enlarged top view of a spacer ring forming part of the antenna mounting structure of FIG. 1;

FIGS. 5 and 6 are enlarged side and top views, respectively, of a cable adaptor plate and coaxial cable forming part of the antenna mounting structure of FIG. 1;

FIGS. 7 and 8 are enlarged top views of a clamping sleeve and insulator disc, respectively, forming part of the antenna mounting structure of FIG. 1;

FIG. 9 is an enlarged side view, partially in section, of an alternative antenna mounting structure according to the invention;

FIG. 10 is a sectional view taken along line 10—10 of FIG. 9; and

FIG. 11 is a side view of another alternative antenna mounting structure in the form of a detachable mounting device.

DESCRIPTION OF A PREFERRED EMBODIMENT

Referring to FIGS. 1-8, an automobile antenna mounting structure is illustrated comprising an antenna base assembly 12, and a cable mounting assembly including a spacer 30, a cable adaptor 25, a clamping sleeve 34, an insulator disc 36, and a cap 20.

The base assembly 12 portion of the antenna mounting structure shown corresponds with that of commonly owned U.S. Appln. Ser. No. 808,151 of Grashow et al., filed June 20, 1977, now U.S. Pat. No. 4,136,986, the disclosure of which is incorporated herein by reference. For the purposes of the present invention, it is important that the base assembly when mounted to a mounting surface 14 have a lower portion 16 of conducting material which may have a generally tubular shape, extending through and disposed beneath the mounting surface 14. An antenna 10 is fitted within and is secured to the base so as to be insulated therefrom and such that the lower portion of the antenna 10 extends into a cavity 38 in the lower base portion 16. The lower portion 16 of the base is also formed with a threaded section 18 at its lower extremity, and has a channel 22 formed lengthwise in the axial direction of the base 12.

The cable adaptor 25 has a ring portion or plate 26 with an aperture **26*a* that fits around the threaded portion 18 of the base, and a cable clamping portion 27 in which the outer lead of a coaxial cable 24 is fixed such that the cable 24 is substantially parallel to the plate at the connection. The inner lead 28 of the coaxial cable 24 extends into the aperture of the plate of the adaptor 25 and is bent at its end 40 perpendicular to the plane of the plate 26 (FIG. 5**).

The remaining parts of the cable mounting assembly include a spacer sleeve 30, which is a ring having a cutout 32, the width of which cutout corresponds with that of the channel 22 in the base lower portion 16. Also included is a clamping sleeve 34 having an inside diameter large enough to fit snugly over the antenna 10 and the bent end 40 of the inner lead 28, an insulator disc 36, which is disposed within the base cavity 38, and finally, a threaded cap 20 which may be secured onto the threaded portion 18 of the base 12.

As described in Grashow application Ser. No. 808,151, the antenna mounting structure shown in the figures may be mounted from the exterior side of the mounting surface. In order to do so, prior to mounting the cable is attached at one end to the antenna, and the free end of the cable is then fed into the mounting aperture. In the mounting structure illustrated in FIGS. 1-8, the cable mounting assembly is attached to the base by placing the spacer sleeve 30 over the threaded portion 18 of the base 12, and aligning the respective slots 32 and 22. The cable adaptor 25 is then placed on the threaded portion 18 of the base such that the inner lead 28 extends through the slots 32 and 22 into the base cavity 38, and the plate 26 rests against the bottom of spacer sleeve 30. As a result, the cable 24 extends at a right angle from the base lower portion, thereby reducing the amount of space needed beneath the mounting surface 14. The inner lead 28 of the cable 24, the bent portion 40 of which will now be juxtaposed and coextensive with the lower portion of the antenna 10, is then secured to the antenna by pressing the clamping sleeve 34 over the end of the antenna 10 and bent portion 40 of the inner lead 28. After placing the insulator disc 36 over the bottom of the base, the cap 20 is screwed onto the threaded portion 18 of the base and firmly retains the spacer 30 and plate 26 against the base lower portions 16, the disc 36 acting as an insulating spacer between the cap 20 and the lead wire 28, antenna 10 and clamping sleeve 34.

The antenna mounting structure illustrated in connection with FIGS. 9 and 10 is similar to the above structure, except that the lower threaded section 18 has a hole 22' rather than a channel. In this arrangement, the cable adaptor 25' is formed so as to be mountable on the base threaded portion 18 from the side, the inner lead 28' thus being inserted through the hole 22'. This is accomplished by providing a C-ring plate 26' that is adapted to snap around the lower threaded section 18. The inner lead 28' may have a bent end portion, as in the case of inner lead 28, in which case the plate 26' will have to be tilted when mounting to the base in order to maneuver the inner lead 28 through the hole 22'. In the alternative, the inner lead 28' may extend straight into the base cavity 38, such that it is in contact with the antenna 10. Preferably, the inner lead 28' is thereafter attached to the antenna such as by a clamping sleeve if the inner lead 28' has a bent portion adjacent the antenna, or by soldering.

As shown in FIG. 11, the antenna mounting structure and cable mounting assembly according to either of the aforementioned embodiments may be used as part of secondary mounting structure, for example a detachable mounting structure which is attached temporarily to a mounting surface. In the arrangement shown, the secondary mounting structure 100 has a hemispherical housing 102 in which the antenna mounting structure 12 is mounted as described above with the coaxial cable 24 exiting the inside of the housing 100 through an appropriately dimensioned hole. The bottom surface 104 of the housing 102 is attached to the mounting surface 14 by way of an adhesive, or suction cups, or any other suitable arrangement.

The form of the invention described herein by way of illustration is susceptible of modification in form and detail within the spirit of the invention. All such modifications and variations are intended to be emcompassed within the scope of the invention as defined in the following claims:

I claim:

1. An antenna mounting structure for mounting an antenna on a mounting surface having a limited amount of underspace and attaching a coaxial cable to the antenna comprising:

a base including a means for attaching the base to the mounting surface such that the lower portion thereof is disposed beneath the mounting surface, the antenna being mounted in, but insulated from, the base such that a lower portion of the antenna extends into an interior cavity in the lower portion of the base, an aperture being provided through a side wall of the lower portion of said base to the cavity and being dimensioned such that the inner lead of the coaxial cable can pass therethrough;

cable adaptor means, in the form of a plate with an aperture, for fitting around said lower portion, the outer lead of the coaxial cable being fixed to said plate so that the cable is substantially parallel to the plate at the connection, the inner lead of the coaxial cable extending into the vicinity of the adaptor aperture, the inner lead of the coaxial cable being dimensioned so that at least a portion of it fits within the base aperture and can make contact with the lower portion of the antenna upon mounting of the plate on the lower portion of the base;

means for securing the inner lead to the lower portion of the antenna; and means for securing said cable adaptor means to the lower portion of the base thereby mounting the coaxial cable at a right angle to the axial direction of the base.

2. An antenna mounting structure as claimed in claim 1, wherein the end of said inner lead is bent normal to the axial direction of said lead such that said bent portion is parallel to and in contact with the lower portion of the antenna.

3. An antenna mounting structure as claimed in claim 2, wherein the means for securing the inner lead to the lower portion of the antenna comprises a clamping sleeve inserted over said bent portion and said antenna lower portion.

4. An antenna mounting structure as claimed in claim 3, wherein the lower portion of the base is threaded at its lower extremity, and wherein the means for securing the cable adapter means to the lower portion of the base comprises a threaded cap cooperating with the threaded portion of said base.

5. An antenna mounting structure as claimed in claim 1, wherein said aperture in the lower portion of the base is a channel in the side wall extending in the axial direction of the base from the lower extremity thereof.

6. An antenna mounting structure as claimed in claim 1, wherein said aperture in the lower portion of the base is a hole in the side wall at substantially a right angle to the axial direction of the base.

7. An antenna mounting structure as claimed in claim 6, wherein the cable adapter plate is open at one end to create a channel to its aperture such that said cable adapter means can be inserted onto said base lower portion from a direction perpendicular to the axial direction of the base.

* * * * *